US006989132B2

(12) United States Patent
Yamamoto

(10) Patent No.: US 6,989,132 B2
(45) Date of Patent: Jan. 24, 2006

(54) LIQUID TRANSFER APPARATUS AND REACTION VESSEL

(75) Inventor: Rintaro Yamamoto, Kyoto (JP)

(73) Assignee: Shimadzu Corporation, Kyoto (JP)

( * ) Notice: Subject to any disclaimer, the term of this patent is extended or adjusted under 35 U.S.C. 154(b) by 520 days.

(21) Appl. No.: 10/058,506

(22) Filed: Jan. 28, 2002

(65) Prior Publication Data

US 2002/0114740 A1 Aug. 22, 2002

(30) Foreign Application Priority Data

Jan. 31, 2001 (JP) ..... 2001-023048

(51) Int. Cl.
*B01L 3/02* (2006.01)

(52) U.S. Cl. ..... 422/100; 73/864.02; 73/864.11; 73/864.13; 73/864.14; 73/864.15

(58) Field of Classification Search ..... 422/100; 73/864.02, 864.11, 864.13, 864.14, 864.15
See application file for complete search history.

(56) References Cited

U.S. PATENT DOCUMENTS 4,537,231 A * 8/1985 Hasskamp ..... 141/238
5,000,921 A * 3/1991 Hanaway et al. ..... 422/100
5,700,695 A * 12/1997 Yassinzadeh et al. ..... 436/180
6,024,925 A * 2/2000 Little et al. ..... 422/100
6,423,536 B1 * 7/2002 Jovanovich et al. ..... 435/287.2

* cited by examiner

*Primary Examiner*—Jan M. Ludlow
(74) *Attorney, Agent, or Firm*—Rankin, Hill, Porter & Clark LLP

(57) ABSTRACT

A capillary 1 is moved to a position above a vessel 17 having a solution 15 stored therein. Then, the vessel 17 is raised while the inside of a tube 5 is opened to an ambient pressure until one end 1*a* of the capillary 1 is dipped into the solution 15. The solution 15 is introduced into the capillary 1 by means of capillarity. Next, the vessel 17 is lowered, to thereby removing the end 1*a* of the capillary 1 from the solution 15 stored in the vessel 17. Subsequently, the capillary 1 is moved to a position above a vessel 19 to which the solution 15 is to be transferred. Then, the tube 5 is connected to a pressure mechanism, thereby pressurizing the inside of the capillary 1 from another end 1*b* thereof. The solution 15 in the capillary 1 is then discharged to the vessel 19.

14 Claims, 7 Drawing Sheets

PRESSURIZATION
5
1b
3
1
1a
15
17
19

LIQUID TRANSFER APPARATUS AND REACTION VESSEL

BACKGROUND OF THE INVENTION

1. Field of the Invention

The present invention relates to a reaction vessel and a liquid transfer apparatus for handling a small amount of liquid.

The liquid transfer apparatus according to the present invention is to be used for, e.g., micropipet. More particularly, the liquid transfer apparatus is used for transferring a small amount of solution from a reaction vessel to another vessel.

The reaction vessel according to the present invention is to be used for pretreatment for any type of analysis; e.g., enzyme treatment, derivatization, or gene amplification.

2. Description of the Related Art

At the time of handling of a small amount of liquid sample (hereinafter called simply a "sample"), a 96-well or 384-well microtiter plate is used as a reaction vessel. Further, a capillary is used as a reaction vessel. A sample and a reagent are sealed and react with each other in the capillary.

A transfer pipet is used as a liquid transfer apparatus for handling a small amount of sample. The transfer pipet aspirates and discharges a sample in and from a tube-like nozzle by means of an aspirating and discharging mechanism, such as a syringe.

In relation to the scale of reaction conforming to the volume of the vessel, the cost of reagents becomes a heavy burden. For instance, in the fields of various screening and genotyping operations, a reduction in the scale of reaction (on the order of nanoliter) has been pursued. In addition, there exists demand for improved efficiency attained by means of simultaneously processing a lot of samples.

In the related-art liquid transfer apparatus using a syringe, however, for a reduction of the scales of reaction, there is limitation caused from the volume of the syringe. Further, there is another limitation that the liquid transfer apparatus becomes complicated in accordance with an increase in the number of channels assigned to the samples. Moreover, recycling of a few channels is troublesome, for reasons of an increase in a turnaround time because of a necessity of rinsing the nozzle and an increase in the time required to move nozzles.

In a case where reaction of a small amount of sample is effected in the reduced volume of a reaction vessel, the vessel must be sealed for preventing a change in the concentration of a reagent resulting from evaporation or cessation of reaction resulting from insufficient mixing. In a case where the vessel is sealed, in order to extract a sample after reaction, the hermetic state of the inside of the vessel must be broken. Hence, many precautions are to be taken, such as a precaution against a loss of the sample which would be induced by a change in the pressure of a minute space causing from opening and closing of the vessel.

SUMMARY OF THE INVENTION

An object according to the invention is to provide a liquid transfer apparatus and a reaction vessel which enable handling of a small amount of solution.

In order to attain the foregoing object, a liquid transfer apparatus according to the present invention comprises:

a capillary for aspirating liquid from one end thereof by means of capillarity;

a pressure mechanism for pressurizing an inside of the capillary from the other end of the capillary; and a connection mechanism for bringing the other end of the capillary into an ambient pressure or a state in which the outer end of the capillary is connected to the pressure mechanism.

One end of the capillary is dipped into the solution while the other end of the capillary is opened to the ambient pressure by means of the connection mechanism. The solution is aspirated into the capillary by means of capillarity. The amount of solution to be aspirated is determined by an inner diameter and length of the capillary. Subsequently, the other end of the capillary is connected to the pressure mechanism by means of the connection mechanism. The inside of the capillary is pressurized by means of the pressure mechanism from the other end of the capillary, thereby discharging the solution to the outside. Therefore, a small amount of solution can be handled. Particularly, when the amount of liquid to be handle is fixed, such as in the case of application of the liquid transfer apparatus to predetermined pretreatment for an analysis system, there can embodied efficient transfer corresponding to a small amount of sample with a simple structure. Further, even in the case of a large number of samples, the samples can be transferred by means of increasing the number of capillaries.

The foregoing object also can be achieved by a reaction vessel, comprising:

a vessel substrate having at least one recess formed in one surface thereof; and an elastic member for covering the surface of the vessel substrate in which the recess is formed.

After the solution has been stored in the recess of the vessel substrate, the elastic member is laid over the vessel substrate so that the elastic member covers the surface of the vessel substrate where the solution is stored in the recess. Thus, a hermetic reaction space to be used for reacting a small amount of solution can be formed. After reaction, the capillary is penetrated through the elastic member. By means of deformation of the elastic member, the inside of the reaction space is pressurized, thus extracting the solution into the capillary from the inside of the recess.

Further, in the above-mentioned reaction vessel, it is preferable that the vessel substrate has a discharge section formed on the bottom of the recess so that the discharge section becomes ruptured by pressure when the elastic member is urged toward the recess.

After the solution has been stored in the recess of the vessel substrate, the elastic member is laid over the vessel substrate so that the elastic member covers the surface of the vessel substrate where the solution is stored in the recess. Thus, a hermetic reaction space to be used for reacting a small amount of solution can be formed. After reaction, the elastic member is urged toward the inside of the recess, and thus the reaction space is pressurized, thereby rupturing the discharge section. Thus, the solution is recovered from the bottom of the recess.

Preferably, the connection mechanism has a hermetic space formation member and a switching mechanism. The hermetic space formation member forms a hermetic space between the other end of the capillary and the pressure mechanism. The switching mechanism brings the hermetic space into a sealed state or into an ambient pressure by means of switching action of a valve.

Preferably, the connection mechanism has a capillary support member and a pressure unit. The capillary support member is brought into hermetic contact with an outer periphery of the capillary. The pressure unit is removably connected to the capillary support member. The pressure unit forms a hermetic space between the other end of the capillary and the pressure mechanism when connected to the capillary support member.

Preferably, there action vessel further comprises a guide member having a through hole for guiding the capillary or an urging member which urges the elastic member toward the recess. The through hole is formed so as to correspond to the position of the recess.

Preferably, the reaction vessel further comprises a pair of heat conductive members for sandwiching the vessel substrate and the elastic member.

Preferably, a through hole for guiding the capillary or an urging member which urges the elastic member toward the recess is formed in the heat conductive member facing the elastic member and in the position corresponding to the position of the recess.

BRIEF DESCRIPTIONS OF THE DRAWINGS

DETAILED DESCRIPTIONS OF THE INVENTION

Figures 1A, 1B, 1C, 1D:
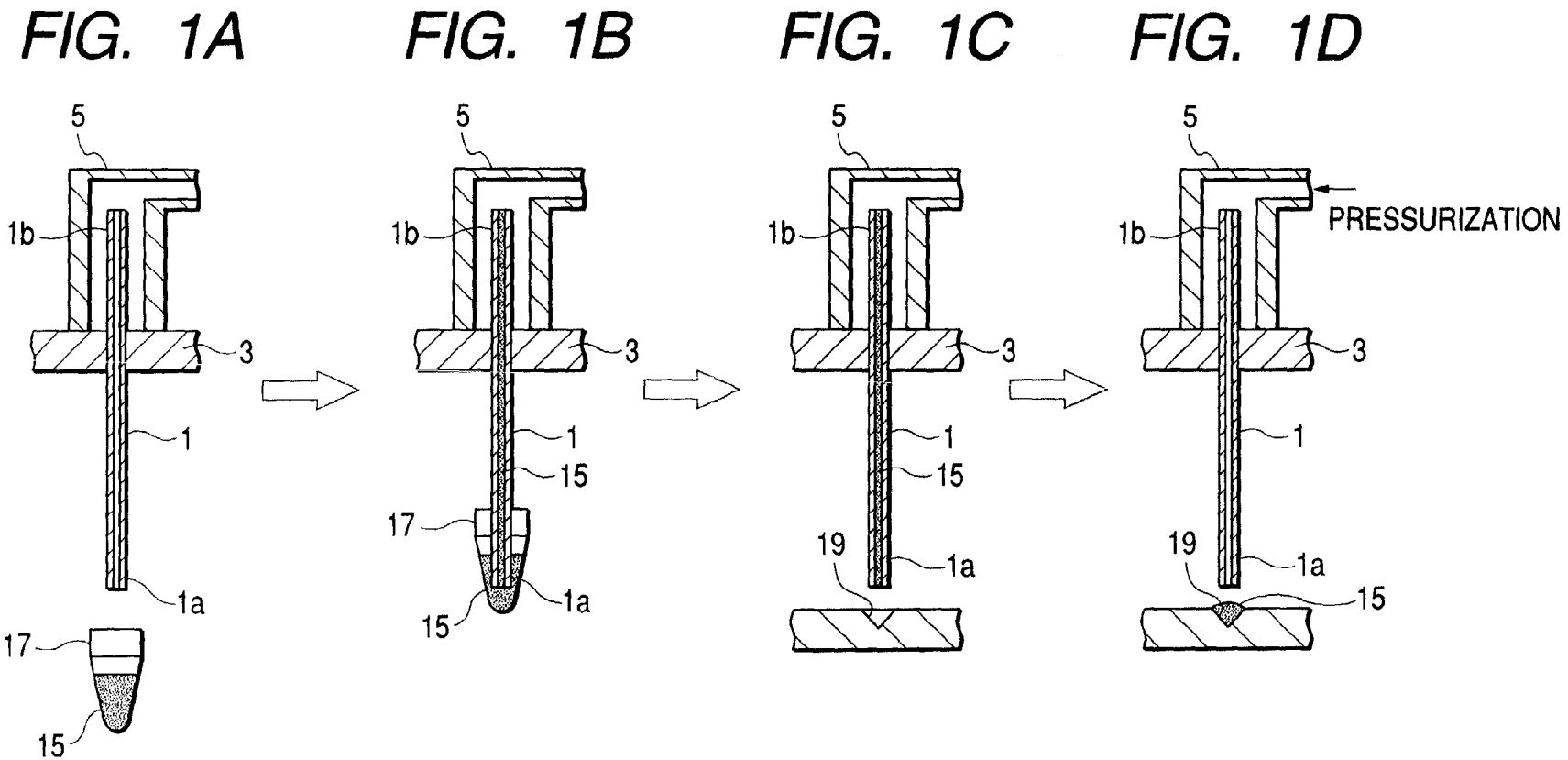
FIGS. 1A through 1D are illustrations showing operations of a liquid transfer apparatus according to a first embodiment of the present invention.

FIGS. 1A through 1D are illustrations showing operations of a first embodiment of a liquid transfer vessel. FIG. 2 is a schematic view showing a portion of the liquid transfer vessel according to the first embodiment with a portion thereof being represented in cross section. FIGS. 1A through 1D omit illustration of a three-way valve 7, an air release channel 9, a pressure channel 11, and a pressure mechanism 13. The configuration of the liquid transfer apparatus according to the first embodiment will now be described by reference to FIGS. 1A through 2.

The liquid transfer apparatus includes a plate-shaped support member 3 having a through hole formed therein. A capillary (capillary tube) 1 is fixedly into the through hole of the support member 3 while one end 1*a* is oriented downward and another end 1*b* is oriented upward. The space between the capillary 1 and the through hole of the support member 3 is hermetically sealed.

One end of a tube 5 is connected to a part of the surface of the support member 3 facing the end 1*b* of the capillary, so as to cover the end 1*b*. The other end of the tube 5 is connected to the three-way valve 7. The air release channel 9 and the pressure channel 11 connected to the pressure mechanism 13 are also connected to the three-way valve 7. The three-way valve 7 switchably connects the tube 5 to the air release channel 9 or the pressure channel 11. The pressure mechanism 13 supplies a pressurization gas to the pressure channel 11, to thereby pressurize the inside of the capillary 1 by way of the three-way valve 7 and the tube 5. For example, a compressor, a pressurized gas cylinder, or a syringing mechanism can be employed as the pressure mechanism 13.

A hermetic space formation member constituting the liquid transfer apparatus according to the present invention is constituted of the support member 3 and the tube 5. Further, a switching mechanism is constituted of the three-way valve 7. A connection mechanism constituting the liquid transfer apparatus according to the present invention is constituted of the support member 3, the tube 5, the three-way valve 7, the air release channel 9, and the pressure channel 11.

The operation of the liquid transfer apparatus will now be described by reference to FIGS. 1A through 2.

Figure 2:
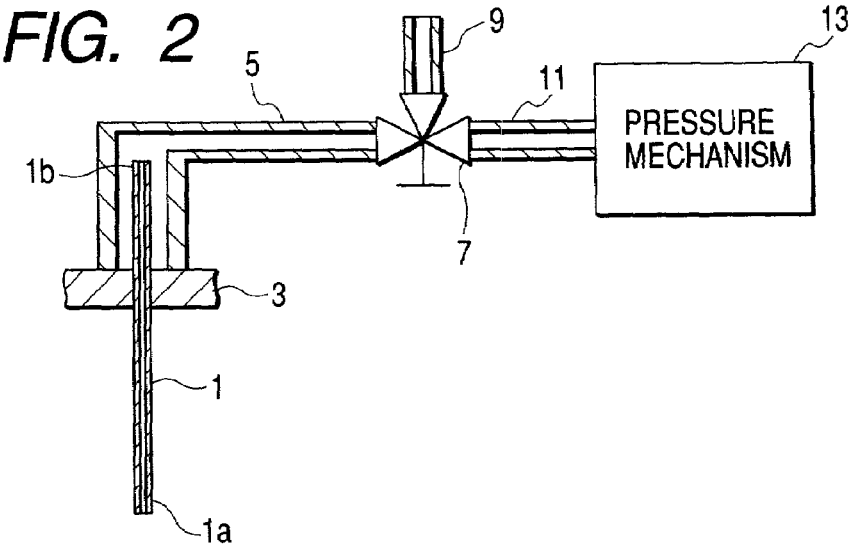
FIG. 2 is a schematic view showing a portion of the liquid transfer apparatus according to the first embodiment with a portion thereof being represented in cross section.

(1) As shown in FIG. 1A, the capillary 1 is moved to a position above a vessel 17 having stored therein a solution to be transferred, such as a sample or a reagent.

(2) While the tube 5 is connected to the air release channel 9 via the three-way valve 7, the vessel 17 is raised until the end 1*a* of the capillary 1 is dipped into the solution 15 as shown in FIG. 1B. By means of capillarity, the solution 15 enters and fills the capillary 1. The amount of solution 15 aspirated into the capillary 1 depends on the volume of the capillary 1. For example, for the amount of solution of 0.5 mL, the capillary which has an inner diameter of 100 $\mu$m, an outer diameter 300 $\mu$m and a length of 64 mm is used. However, generally, the capillary which has an inner diameter of from 50 to 100 $\mu$m and an outer diameter of from 200 to 350 $\mu$m is used. Subsequently, the three-way valve 7 is switched so as to connect the tube 5 to the pressure channel 11.

(3) After the end 1*a* of the capillary 1 has been separated from the solution 15 in the vessel 17 by means of lowering the vessel 17, the capillary 1 is moved to another vessel 19 to which the solution is to be transferred, as shown in FIG. 1C.

(4) Next, a pressurization gas is supplied to the pressure channel 11 by means of the pressure mechanism 13, thus pressurizing the inside of the capillary 1 from the other end 1*b* of the capillary 1 by way of the three-way valve 7 and the tube 5. Thus, the solution 15 held in the capillary 1 is discharged into the vessel 19, as shown in FIG. 1D. Hence, the amount of solution 15 determined by the volume of the capillary 1 is stored in the vessel 19.

In the first embodiment, the liquid transfer apparatus has only one capillary. When solutions stored in a 96-well or 384-well titer plate are to be transferred, a plurality of capillaries are arranged so as to conform to the positions of wells on the plate. When the capillaries are pressurized with a pressure sufficiently greater than the tube resistance of the capillaries, a plurality of samples can be transferred concurrently.

The inside of the capillary 1 can be rinsed through repetition of dipping the end 1*a* into a rinsing liquid such that the inside of the capillary 1 is filled with the rinsing liquid, and then discharging the rinsing liquid to a drainage.

If the capillary 1 is made disposable, by hermetically holding an inexpensive capillary with an elastic member (elastomer), rinsing of the capillary 1 is obviated.

Figure 3:
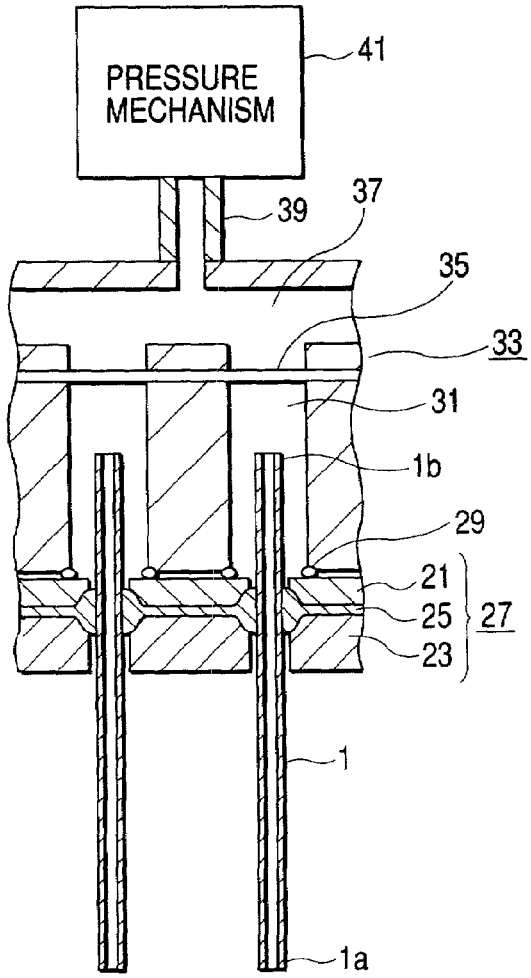
FIG. 3 is a schematic view showing a second embodiment of a liquid transfer apparatus with a portion thereof being represented in cross section.

FIG. 3 is a schematic view showing a second embodiment of a liquid transfer apparatus with a portion thereof being represented in cross section. In the second embodiment, a capillary is disposable, and a diaphragm is employed as a liquid discharge mechanism. Those which are identical with the elements shown in FIG. 1 are assigned the same reference numerals, and their explanations are omitted.

An elastomer 25 is sandwiched between a top plate 21 and a base plate 23. The plates 21,23 respectively have a plurality of through holes to be used for receiving capillaries, and the through holes are formed in corresponding positions of the capillaries. The capillaries 1 are inserted into respective through holes of the top and base plates 21, 23 and penetrate through the elastomer 25 while the ends 1*a* of the capillaries are oriented downward and the other ends 1*b* are oriented upward. Thus, the capillaries 1 are hermetically secured by the elastomer 25. Here, the top plate 21, the base plate 23, and the elastomer 25 constitute a capillary support member 27.

The surface of the top plate 21 that faces away from the elastomer 25 is removably brought into hermetic contact with a pressure unit 33 via an O-ring 29. The pressure unit 33 has a plurality of pressure chambers 31 for individually covering the ends 1*b* of the capillaries 1 and forming hermetic spaces. One wall surface of the individual pressure chamber 31 is formed from a diaphragm 35. The pressure unit 33 has a common pressure chamber 37 at the space adjacent to the side of each diaphragm 35 that faces away from the pressure chamber 31. The pressure unit 33 further has a tube 39 for connecting the common pressure chamber 37 to a pressure mechanism 41. The common pressure chamber 37, exclusive of the portion thereof connected to the tube 39, is a hermetic space. The pressure mechanism 41 is for pressurizing a pressurization gas to the tube 39, to thereby pressurize the inside of the common pressure chamber 37. Among other devices, a compressor, a pressurized gas cylinder, or a syringing mechanism can be employed as the pressure mechanism 41.

A connection mechanism constituting the liquid transfer apparatus according to the present invention is constituted of the capillary support member 27 having the top plate 21, the base plate 23, and the elastomer 25, and the pressure unit 33 having the O-ring 29, the pressure chambers 31, the diaphragm 35, the common pressure chamber 37, and the tube 39.

FIG. 4 shows operations of the liquid transfer apparatus shown in FIG. 3.

Figure 4E:
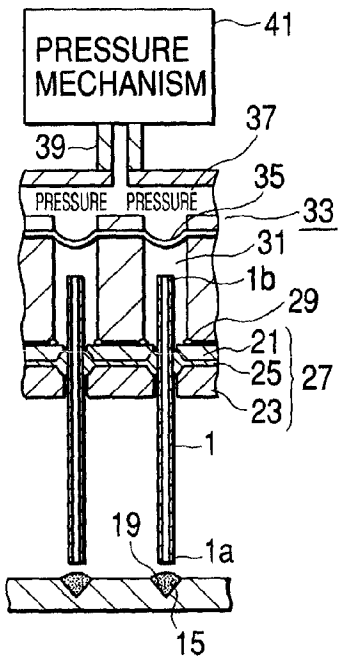
FIGS. 4A through 4E are illustrations showing operations of the liquid transfer apparatus according to the second embodiment of the present invention.
Figure 4D:
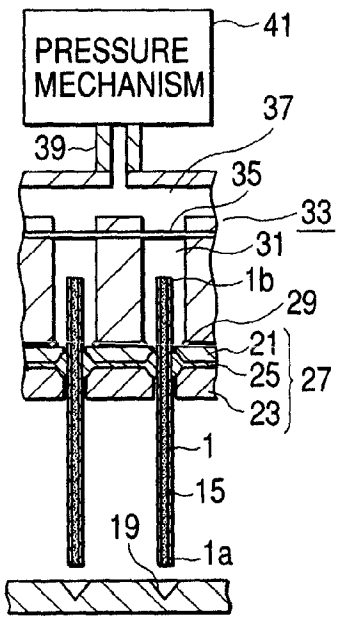
Figure 4C:
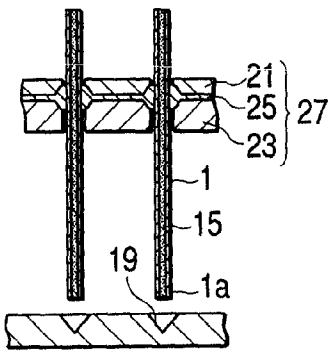
Figure 4B:
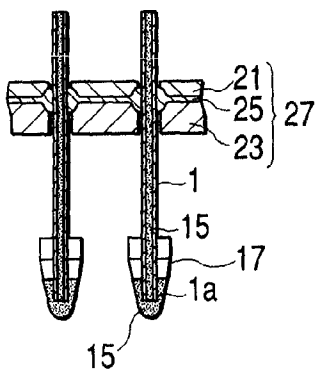
Figure 4A:
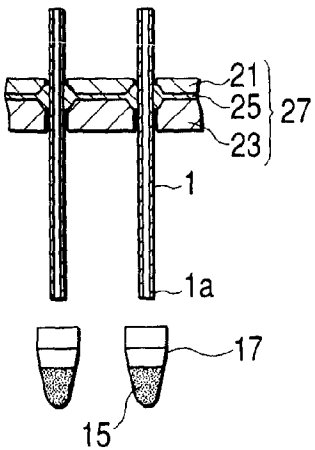

(1) The capillary support member 27 separated from the pressure unit 33 is moved to a position above a plurality of vessels 17 which are arranged so as to conform with the layout of the capillaries 1 and which store the solutions 15 to be transferred, as shown in FIG. 4A. The capillaries 1 are located in positions above the corresponding vessels 17.

(2) The ends 1*a* of the respective capillaries 1 are dipped into the solutions 15 by means of raising the vessels 17, as shown in FIG. 4B. Thus, the solutions 15 enter and fill the capillaries 1 by means of capillarity. The amount of solution 15 aspirated into each capillary 1 is determined by the volume of each capillary 1.

(3) Next, the vessels 17 are lowered, thereby separating the ends 1*a* of the capillaries 1 from the solutions 15 of the vessels 17. Subsequently, the capillary support member 27 is moved to a position above vessels 19 which are arranged so as to conform with the layout of the capillaries 1 and into which the solutions are to be transferred, as shown in FIG. 4C. The capillaries 1 are located in positions above the corresponding vessels 19.

(4) Then, the pressure unit 33 is attached to the capillary support mechanism 27 by means of the O-ring 29.

(5) Via the tube 39, a pressurization gas is supplied to the common pressure chamber 37 by means of the pressure mechanism 41. As a result of the common pressure chamber 37 being pressurized, the diaphragm 35 is urged toward the pressure chambers 31, thereby pressurizing the pressure chambers 31. As a result of the pressure chambers 31 being pressurized, the capillaries 1 are pressurized from the other sides 1*b* to thereby discharging the solutions 15 held in the capillaries 1 into the vessels 19. The solutions 15 whose amounts are determined by the volumes of the capillaries 1 are stored in the respective vessels 19.

In the second embodiment, the pressure chamber 31 enclosing the end 1*b* of the capillary 1 is pressurized by the diaphragm 35, thereby preventing occurrence of excessive inflow of a gas from the end 1*a* of the capillary 1 after discharge of the solution. Hence, there can be inhibited occurrence of bubbles in the solution 15 stored in the vessel 19 or evaporation of the solution 15.

In the second embodiment, a plurality of capillaries 1 simultaneously discharge a solution by means of pressurizing the common pressure chamber 37. If separate pressurization spaces are assigned to the respective pressure chambers 31 via a diaphragm 35, discharge of a solution from an arbitrary capillary 1 can be selected. If there is provided a pressure unit corresponding solely to one capillary, discharge of a solution from an arbitrary capillary 1 can be selected.

In the second embodiment shown in FIGS. 3 through 4E, the diaphragm 35 is urged toward the pressure chambers 31 by means of a pressurization gas. However, the present invention is not limited to such an embodiment. The diaphragm 35 may be fluctuated upward and downward by means of, for example, a solenoid or a piezoelectric element.

Figure 5A:
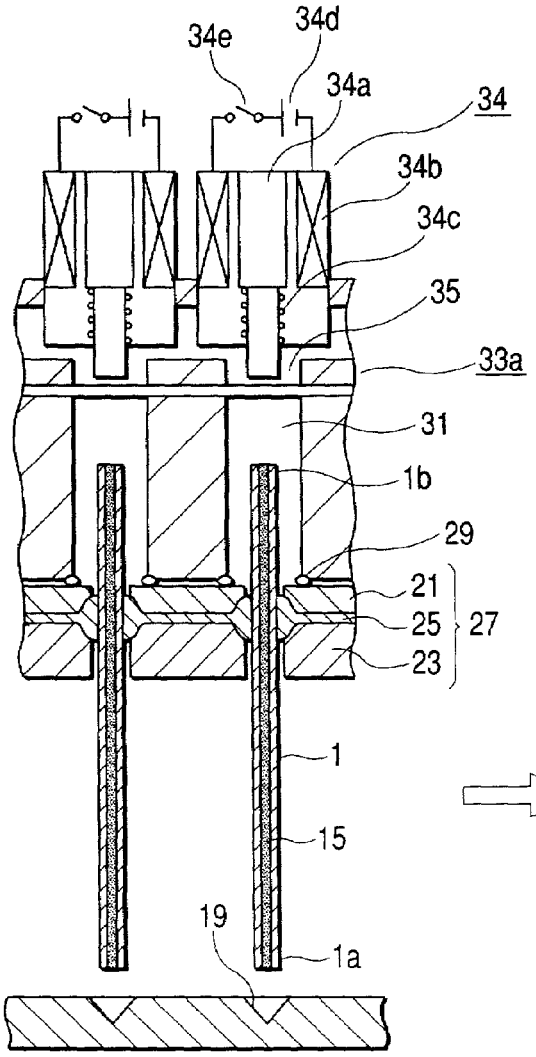
FIGS. 5A and 5B are side cross-sectional views showing operation of a third embodiment of a liquid transfer apparatus.
Figure 5B:
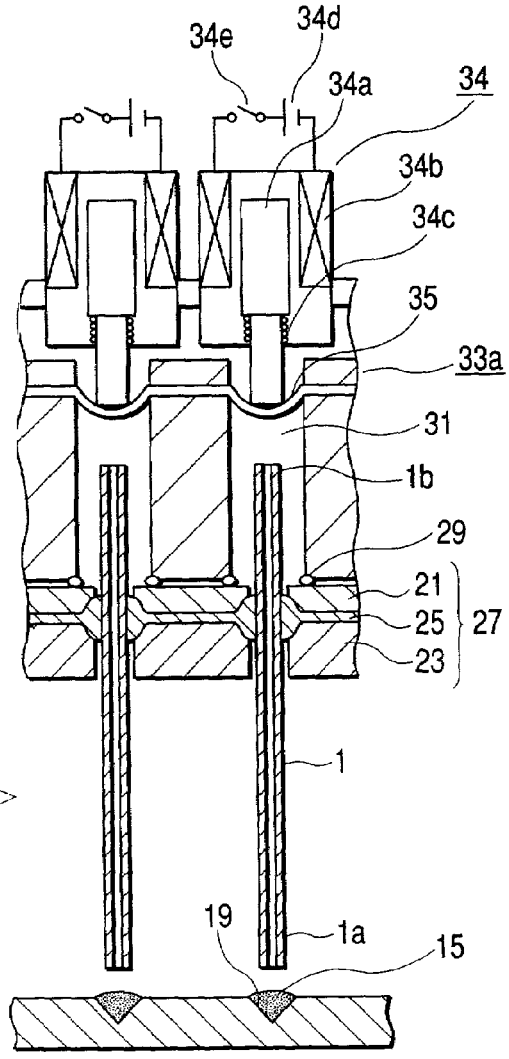

FIGS. 5A and 5B are side cross-sectional views showing operation of a third embodiment of a liquid transfer apparatus. In the third embodiment, there is provided a solenoid as a pressure mechanism for urging the diaphragm 35 toward the pressure chambers 31. Those which are identical with the elements shown in FIG. 1 are assigned the same reference numerals, and their explanations are omitted.

The liquid transfer apparatus has the capillary support member 27 constituted of the top plate 21, the base plate 23, and the elastomer 25. As same as in the case of the second embodiment shown in FIG. 3, a plurality of capillaries 1 are arranged in the capillary support member 27.

The side of the top plate 21 that faces away from the elastomer 25 is removably brought into hermetic contact with a pressure unit 33*a* via the O-ring 29. The pressure unit 33*a* has a plurality of the pressure chambers 31 for individually covering the ends 1*b* of the capillaries 1 and forming hermetic spaces. One wall surface of the individual pressure chamber 31 is formed from the diaphragm 35.

The pressure unit 33*a* has a solenoid 34 serving as a pressure mechanism which is disposed in a position in the vicinity of the side of the diaphragm 35 that faces away from the pressure chamber 31. The solenoid 34 is assigned to each of the pressure chambers 31. The solenoid 34 has a core member 34*a*, a coil 34*b*, a spring 34*c*, a power source 34*d*, and a switch 34*e*. The core member 34*a* has magnetic properties for urging the diaphragm 35 toward the pressure chamber 31. The coil 34*b* and the spring 34*c* drive the core member 34*a* to slidably move. The power source 34*d* applies an electric current to the coil 34*b*. The switch 34*e* controls energization of the coil 34*b*. When the switch 34*e* is in an OFF state and no current flows into the coil 34*b*, the core member 34*a* is urged toward the coil 34*b* by means of the spring 34*c*. In contrast, when the switch 34*e* is in an ON state and an electric current flows to the coil 34*b*, the core member 34*a* is urged toward the diaphragm 35 by means of the magnetic field caused by the coil 34*b*.

A connection mechanism constituting the liquid transfer device according to the third invention is constituted of the capillary support member 27 having the top plate 21, the base plate 23, and the elastomer 25, and the pressure unit 33*a* having the O-ring 29, the pressure chamber 31, and the diaphragm 35.

The operation of the liquid transfer apparatus according to the third embodiment is described.

(A) As same as in the case of steps shown in FIGS. 4A through 4C, the solution 15 is aspirated into the capillaries 1, and the capillary support member 27 is moved to a position above the vessels 19. Subsequently, the pressure unit 33*a* is attached to the capillary support mechanism 27 via the O-ring 29 as shown in FIG. 5A. At this time, the switch 34*e* of the solenoid 34 remains deactivated, and the core member 34*a* remains urged toward the coil 34*b*.

(B) The switch 34*e* is turned on, thereby applying an electric current to the coil 34*b* and causing the coil 34*b* to produce a magnetic field. Thereby, the core member 34*a* is moved toward the diaphragm 35. The core member 34*a* urges the diaphragm 35 toward the pressure chamber 31, thus pressurizing the pressure chamber 31 as shown in FIG. 5B. The inside of the capillary 1 is pressurized from the end 1*b* by means of pressurizing the inside of the pressure chamber 31, thereby discharging the solution 15 held in the capillary 1 into the vessel 19. Thus, the solution 15 whose amount is determined by the volume of the capillary 1 is stored in the vessel 19.

In the third embodiment, so long as a switch 34*a* assigned to a desired capillary 1 is turned on, the solution of an arbitrary capillary 1 can be selectively discharged by means of turning on the switch 34*a*.

Figure 6A:
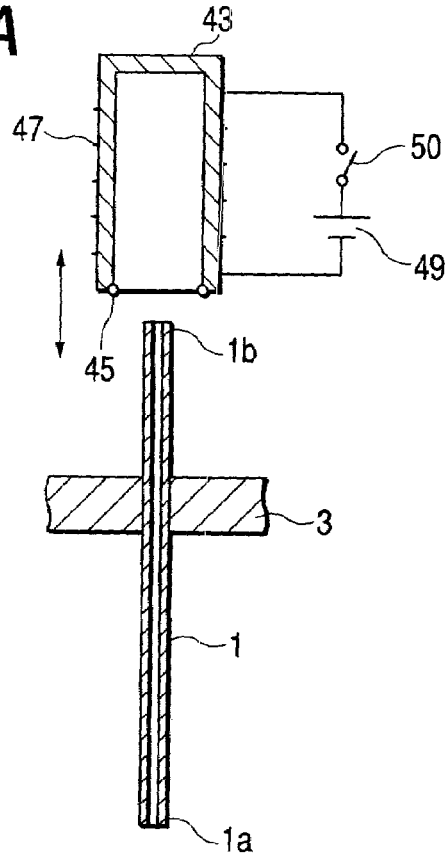
FIG. 6A is a side cross-sectional view showing a fourth embodiment of a liquid transfer apparatus of the present invention.
Figure 6B:
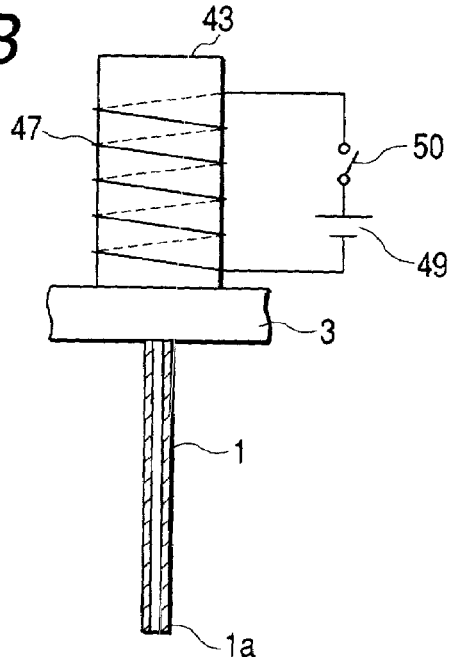
FIG. 6B is a side elevation view showing the fourth embodiment of the liquid transfer apparatus of the present invention.

FIGS. 6A and 6B show a fourth embodiment of a liquid transfer apparatus. FIG. 6A is a side cross-sectional view and FIG. 6B is a side elevation view. Those which are identical with the elements shown in FIG. 1 are assigned the same reference numerals, and their explanations are omitted.

The capillary 1 is fixedly into the through hole of the support member 3 while one end 1*a* is oriented downward and another end 1*b* is oriented upward. The space between the capillary 1 and the through hole of the support member 3 is hermetically sealed.

A pressure chamber member 43 enclosing the end 1*b* is removably attached to the side of the support member 3 that faces the end 1*b* of the capillary 1. A heater 47 is attached to an outer wall of the pressure chamber member 43. A power supply 49 is electrically connected to the heater 47. Circuitry constituted of the heater 47 and the power supply 49 is provided with a switch 50 for controlling application of power to the heater 47.

In the fourth embodiment, after the solution has been aspirated into the capillary 1 by means of capillarity, the pressure chamber member 43 is attached to the support member 3 while the switch 50 remains off. Then, the switch 50 is then turned on, thereby energizing the heater 47. By means of heat produced by the heater 47, the internal pressure of the pressure chamber member 43 is increased, thereby pressurizing the inside of the capillary 1 from the end 1*b*. Thus, the solution 15 held in the capillary 1 is discharged into the vessel 19.

As mentioned above, the liquid transfer apparatus according to the present invention employs a capillary, and a solution is aspirated into the capillary by means of capillarity. The amount of solution to be aspirated is determined by means of the inner diameter and length of the capillary. Hence, a small amount of solution can be dealt with. Particularly, when the amount of liquid to be handled is fixed, such as application of the present invention to predetermined pretreatment of an analytical system, efficient transfer corresponding to a small amount of sample can be affected with simple structure.

Figure 7:
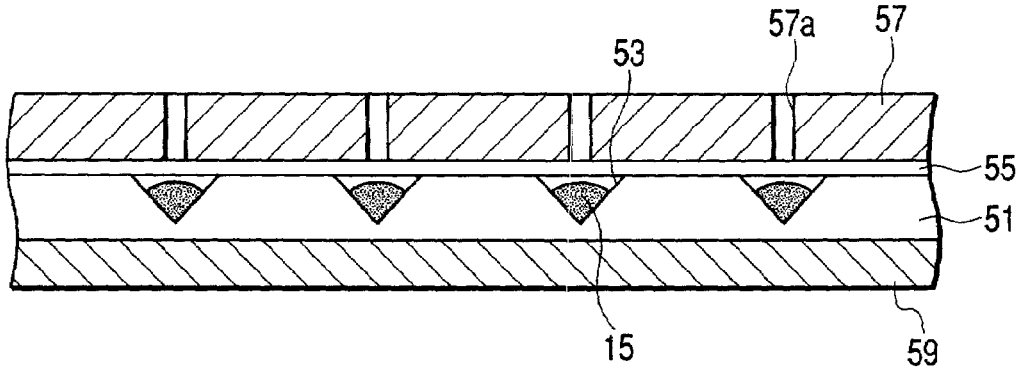
FIG. 7 is a cross-sectional view showing an embodiment of a reaction vessel.

FIG. 7 is a cross-sectional view showing an embodiment of a reaction vessel.

The reaction vessel has a vessel plate (vessel substrate) 51 consisting of, e.g., glass, silicon, or silicon rubber. A plurality of tapered recesses 53 for storing a solution 15 are formed in one surface of the vessel plate 51. A cover plate 55 is made of elastomer, e.g., silicon rubber. The cover plate 55 is brought into hermetic contact with the surface of the vessel plate 51 in which the recesses 53 are formed. The top of each of the recesses 53 is sealed by the cover plate 55, and thus the recesses 53 become hermetic reaction spaces. The hermetic spaces are formed easily by use of elastomer as a material of the cover plate 55.

The vessel plate 51 and the cover plate 55 are sandwiched between a pair of metal plates (heat conductive members) 57, 59. Through holes 57*a* for guiding the respective capillaries 1 are formed in the side of the metal plate 57 that faces the cover plate 55 and in the positions corresponding to the recesses 53. Although not illustrated, a Peltier element is attached as a heating/cooling mechanism for effecting heat control is attached to each of the metal plates 57, 59.

The metal plate 57 serves also as a guide member constituting the reaction vessel according to the present invention.

An example of operation required for preparing a sample through use of a reaction vessel will now be described.

(1) A fluid mixture consisting of, e.g., a sample and a reagent, is discharged into the recess 53 of the vessel plate 51. The liquid transfer apparatus according to the present invention shown in FIGS. 1 through 6B can be used for the discharging operation.

(2) The cover plate 55 is provided on the surface of the vessel plate 51 having the recesses 53 formed therein.

(3) The vessel plate 51 and the cover plate 55 are sandwiched between the metal plates 57, 59, thereby sealing the recess 53.

(4) By means of the Peltier elements (not shown) attached to the metal plates 57, 59, the plates are heated cyclically, thereby promoting reaction of the sample with the reagent in the recess 53.

Figure 8:
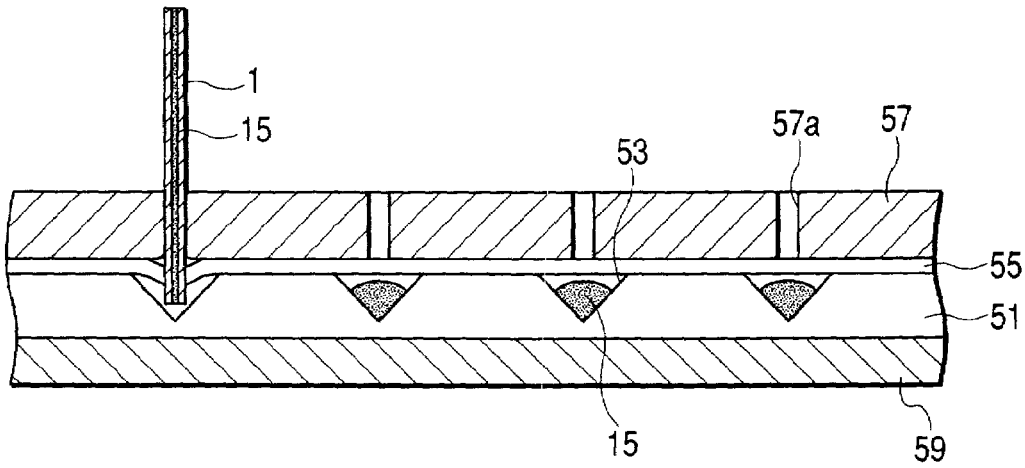
FIG. 8 is a cross-sectional view showing an example process for extracting solution from a well according to the embodiment.

FIG. 8 is a cross-sectional view showing an example of process for extracting the solution from the recess in the reaction vessel shown in FIG. 7.

The capillary 1 is stuck into the cover plate 55 via the through hole 57*a* formed in the metal plate 57. At this time, by means of an increase in the internal pressure of the recess 53 causing from deformation of the cover plate 55 made of elastomer and the capillarity of a capillary, the solution held in the recess 53 is aspirated into the capillary 1. The sample thus-aspirated into the capillary 1 can be extracted to an arbitrary location by means of pressurizing the inside of the capillary 1.

As a result of use of elastomer as material of the cover plate 55, the capillary 1 penetrates through the cover plate 55 at the time of extraction of the solution held in the recess 53, thereby enabling contact with the sample. Thus, there is no necessity for removing the coverplate 55 forming the hermetic space, thus preventing loss of the solution in the recess 53.

The liquid transfer apparatus according to the present invention can be used for extracting a solution from the recess 53.

So long as a plurality of capillaries 1 are provided, simultaneous processing of a plurality of samples can be affected.

Next, an example method of preparing the vessel plate 51 made from elastomer will be described.

(1) A mold having protuberances is formed on a silicon wafer by means of, e.g., chemical etching.

(2) In order to facilitate removal of the container plate in a post operation, the surface of the mold is processed with silane. The mold was subjected to silane treatment through use of 3% (v/v) dimethyloctadecylchlorosilane/0.025% $H_2O$ in toluene (a solution made by adding water in 0.025% volume ratio to toluene, and by adding dimethyloctadecylchlorosilane to the mixture in 3% volume ratio) for two hours.

(3) The mold is fixed in a molding box.

(4) The polymer material and hardener thereof are drawn into the molding box. For example, Sylgard 184 (produced by U.S. Dow Corning, and Sylgard is the tradename of Down Corning Co., Ltd.) and hardener thereof are mixed in proportions by weight of 10:1, and the mixture was hardened for four hours at 65°.

(5) The thus-hardened polymer material is removed from the mold, whereby a vessel plate having recesses into which the protuberances of the mold have been transferred is formed.

Further, PDMS (Poly(dimethylsiloxane)) plate is formed by the same manner as the vessel plate, and is used as the cover plate 55.

Microprocessing of elastomer can be affected not by etching but by a replica method using a mold. Hence, a reaction vessel can be manufactured very inexpensively. As a result, the reaction vessel can be made disposable, thereby obviating a rinsing process or a risk of contamination.

In order to attain stable thermal conductivity at the time of heat control of the container plate 51 and the cover plate 55 or to cause the capillary 1 to penetrate through the cover plate 55 at the time of extraction of a sample, the thickness of polymer must be controlled in connection with the preparation method set forth. Use of spin coating for drawing polymer material into a mold is preferable.

As another preparation method of the vessel plate 51, there may be provided a method of forming the recesses 53 in the surface of a silicon substrate or in the surface of a glass substrate, by use of an optical lithography technique and an etching technique. These methods facilitate an increase in the packing density of minute recesses. If the optical lithography technique or the etching technique is employed at the time of formation of the mold, an increase in the packing density of protuberances can be increased readily. Therefore, he packing density of minute recesses can be increased.

Figure 9:
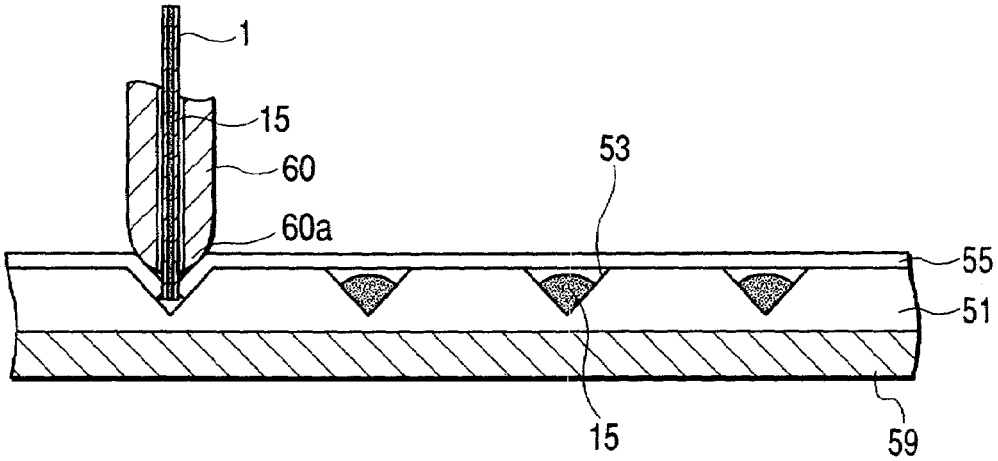
FIG. 9 is a cross-sectional view showing another example process for extracting solution from a well according to the embodiment.

FIG. 9 is a cross-sectional view showing another example of process for extracting a solution from the recess of the reaction vessel shown in FIG. 7. At the time of extraction of a solution from the recess 53, the internal pressure of the recess 53 is forcefully increased, thereby introducing the solution into the capillary 1 without failure.

A sleeve 60 has a tip end 60*a* matching in shape with the recess 53. The capillary 1 is inserted and held in the sleeve 60. After removal of the metal plate 57 from the cover plate 55, the capillary 1 is penetrated through the cover plate 55, and the cover plate 55 is urged toward the recess 53 by the sleeve 60. Thus, the internal pressure of the recess 53 is increased, and the solution is introduced into the capillary 1. Then, the capillary 1 is removed from the cover plate 55 while the position of the sleeve 60 is retained, the solution can be extracted from the recess 53.

The sleeve 60 can be attached to the liquid transfer apparatus according to the present invention.

Figure 10:
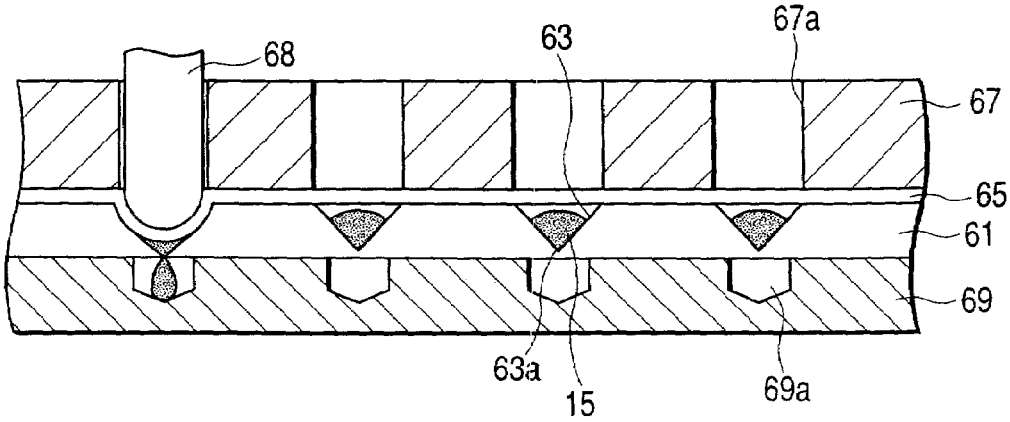
FIG. 10 is a cross-sectional view showing another embodiment of a reaction vessel.

FIG. 10 is a cross-sectional view showing another embodiment of a reaction vessel.

The reaction vessel has a vessel plate 61 formed from, e.g., glass, silicon, or silicon rubber. A plurality of tapered recesses 63 for storing the solution 15 are formed in one surface of the vessel plate 61. The bottom of each of the recesses 63 is thinly formed, to thereby form a discharge section 63*a*.

A cover plate 65 is formed from elastomer e.g., silicon rubber. The cover plate 65 is brought into hermetic contact with the side of the vessel plate 61 in which the recesses 63 are formed. The top of each of the recesses 63 is sealed by the cover plate 65, so that the recesses 63 become hermetic reaction spaces.

A guide plate (guide member) 67 is provided on the side of the cover plate 65 that faces away from the vessel plate 61. A plurality of through holes 67*a* are formed in the guide plate 67 in the positions corresponding to the positions of the recesses 63. The through holes 67*a* guid a pressurization shaft (urging member) 68 which urges the vessel plate 65 toward the recesses 63. The tip end of the pressurization shaft 68 is formed roundly so as to conform with the geometry of the recess 63.

A reservoir plate 69 is provided on the side of the vessel plate 61 that faces away from the recesses 63. A plurality of recesses are formed as reservoirs 69*a* in the reservoir plate 69 in the positions corresponding to the positions of the discharge sections 63*a* of the recesses 61.

The vessel plat 61 and the cover plate 65 are sandwiched between the guide plate 67 and the reservoir plate 69.

At the time of extraction of a solution from the recess 63, the pressurization shaft 68 is inserted into the through hole 67*a* of the guide plate 67, thereby urging the cover plate 65 toward the inside of the recess 63 and compressing the internal space of the recess 63. Eventually, the internal pressure of the recess 63 increases, and the discharge section 63*a* that is the thinnest portion in an internal wall of the recess 63 becomes ruptured. The solution is then discharged to the reservoir 69*a* from the recess 63.

The present embodiment obviates a necessity for removing the cover plate 65 forming the hermetic space, thus preventing loss of the solution from the inside of the recess 63.

If a heat conductive material is used for the guide plate 67, the guide plate 67 can serve also as the heat conductive member constituting the reaction vessel according to the present invention.

At the time of formation of the vessel plate 61 shown in FIG. 10 in the same manner as the vessel plate 51 made of elastomer, the thickness of the bottom of the recess 63, that is, the thickness of the discharge section 63*a*, is determined by the difference between the height of the protuberance of the mold and the thickness of the vessel plate 61. The height of the protuberance of the mold is determined at the time of the formation of the mold, a suitable discharge section 63*a* can be obtained by controlling the thickness of the polymer material to be drawn into the mold by means of the spin-coating.

The embodiments of the liquid transfer apparatus and the reaction vessels according to the present invention have been described above. However, the present invention is not limited to the embodiments and is applied to various modifications within the scope of the invention claimed in the appending claims.

What is claimed is:

1. A liquid transfer apparatus comprising:

a capillary for aspirating liquid from one end thereof by means of capillarity;

a pressure mechanism for pressurizing an inside of the capillary from an other end of the capillary; and a connection mechanism for bringing the other end of the capillary into, alternately, an ambient pressure state and a state in which the other end of the capillary is connected to the pressure mechanism, wherein the connection mechanism comprises:

a capillary support member adapted for hermetic contact with an outer periphery of the capillary, said capillary support member having an elastic member for hermetically securing the capillary to the capillary support; and a pressure unit removably connected to the capillary support member, wherein the pressure unit forms a hermetic space between the other end of the capillary and the pressure mechanism when connected to the capillary support member, and wherein the pressure unit has a first pressure chamber with a diaphragm on one wall surface thereof for pressurizing an inside of the capillary from the other end of the capillary, and a second pressure chamber connected to the pressure mechanism for urging the diaphragm toward the first pressure chamber and pressurizing an inside of the first pressure chamber.

2. The liquid transfer apparatus according to claim 1, wherein the pressure unit comprises an O-ring for removably connecting the first pressure chamber to the capillary support member.

3. The liquid transfer apparatus of claim 1, wherein the pressure unit further comprises a solenoid for urging the diaphragm toward the first pressure chamber for pressurizing the inside of the capillary.

4. The liquid transfer apparatus of claim 1, wherein said capillary is one of a plurality of capillaries, wherein the pressure unit further comprises a plurality of first pressure chambers and a plurality of diaphragms, each of said diaphragms being associated with one of said plurality of first pressure chambers, each of said plurality of first pressure chambers and each of said plurality of diaphragms being associated with one of said plurality of capillaries so as to cover the other ends of the capillaries and thereby form a plurality of hermetic spaces.

5. The liquid transfer apparatus of claim 4, wherein each of said plurality of first pressure chambers further comprises a solenoid for urging the associated diaphragm toward the first pressure chamber for pressurizing the inside of the associated capillary.

6. A liquid transfer apparatus comprising:

a capillary for aspirating liquid from one end thereof by means of capillarity;

a pressure mechanism for pressurizing an inside of the capillary from an other end of the capillary;

a connection mechanism for bringing the other end of the capillary into, alternately, an ambient pressure state and a state in which the other end of the capillary is connected to the pressure mechanism, wherein the connection mechanism comprises:

a capillary support member adapted for hermetic contact with an outer periphery of the capillary, wherein the capillary support member has an elastic member for hermetically securing the capillary to the capillary support; and a pressure unit removably connected to the capillary support member, wherein the pressure unit forms a hermetic space between the other end of the capillary and the pressure mechanism when connected to the capillary support member, wherein the pressure unit has a first pressure chamber with a diaphragm on one wall surface thereof for pressurizing an inside of the capillary from the other end of the capillary, and wherein the pressure mechanism has an urging member for urging the diaphragm toward the first pressure chamber and pressurizing an inside of the first pressure chamber.

7. The liquid transfer apparatus according to claim 6, wherein the pressure unit comprises an O-ring for removably connecting the first pressure chamber to the capillary support member.

8. The liquid transfer apparatus of claim 6, wherein the pressure unit further comprises a solenoid for urging the diaphragm toward the first pressure chamber for pressurizing the inside of the capillary.

9. The liquid transfer apparatus of claim 6, wherein said capillary is one of a plurality of capillaries, wherein the pressure unit further comprises a plurality of first pressure chambers and a plurality of diaphragms, each of said diaphragms being associated with one of said plurality of first pressure chambers, each of said plurality of first pressure chambers and each of said plurality of diaphragms being associated with one of said plurality of capillaries so as to cover the other ends of the capillaries and thereby form a plurality of hermetic spaces.

10. The liquid transfer apparatus of claim 9, wherein each of said plurality of first pressure chambers further comprises a solenoid for urging the associated diaphragm toward the first pressure chamber for pressurizing the inside of the associated capillary.

11. A liquid transfer apparatus comprising:

a capillary for aspirating liquid from one end thereof by means of capillarity;

a pressure mechanism for pressurizing an inside of the capillary from an other end of the capillary, wherein the pressure mechanism has a heater attached to an outer wall of a pressure unit for heating the pressure unit and increasing an internal pressure of the pressure unit;

a connection mechanism for bringing the other end of the capillary into, alternately, an ambient pressure state and a state in which the other end of the capillary is connected to the pressure mechanism, wherein the connection mechanism comprises:

a capillary support member in hermetic contact with an outer periphery of the capillary; and wherein the pressure unit is removably connected to the capillary support member, wherein the pressure unit forms a hermetic space between the other end of the capillary and the pressure mechanism when connected to the capillary support member.

12. A liquid transfer apparatus comprising:

a plurality of capillaries, each having one end, an other end and an inside, each of said capillaries being adapted to aspirate liquid from the one end thereof by means of capillarity;

a plurality of pressure mechanisms, each of said plurality of pressure mechanisms being associated with one of said plurality of capillaries, wherein each of said pressure mechanisms is adapted for pressurizing the inside of the associated capillary from the other end of the capillary; and a plurality of connection mechanisms, each of said plurality of connection mechanisms being associated with one of said plurality of pressure mechanisms and one of said plurality of capillaries, for bringing the other end of the capillary into, alternately, an ambient pressure state and a state in which the other end of the associated capillary is connected to the associated pressure mechanism, wherein each connection mechanism comprises:

a capillary support member adapted for hermetic contact with an outer periphery of the associated capillary, said capillary support member having an elastic member for hermetically securing the capillary to the capillary support; and a pressure unit removably connected to the capillary support member, wherein the pressure unit forms a hermetic space between the other end of the associated capillary and the pressure mechanism when connected to the capillary support member, the pressure unit defining a pressure chamber with a diaphragm on one wall surface thereof for pressurizing the inside of the associated capillary from the other end of the capillary, and wherein the plurality of pressure mechanisms are independently operable so as to independently pressurize the associated capillary.

13. The liquid transfer apparatus of claim 12, wherein each of the pressure units comprise an O-ring for removably connecting the associated pressure chamber to the capillary support member.

14. The liquid transfer apparatus of claim 12, wherein each pressure unit further comprises a solenoid for urging the associated diaphragm toward the associated pressure chamber for pressurizing the inside of the associated capillary.

* * * * *